US008652265B2

(12) United States Patent
Hays

(10) Patent No.: US 8,652,265 B2
(45) Date of Patent: Feb. 18, 2014

(54) METHOD FOR CLEANING HEAT EXCHANGER TUBE BUNDLES

(76) Inventor: Gary I Hays, Bakersfield, CA (US)

( * ) Notice: Subject to any disclaimer, the term of this patent is extended or adjusted under 35 U.S.C. 154(b) by 0 days.

(21) Appl. No.: 13/313,260

(22) Filed: Dec. 7, 2011

(65) Prior Publication Data

US 2012/0073602 A1 Mar. 29, 2012

Related U.S. Application Data

(62) Division of application No. 12/847,697, filed on Jul. 30, 2010, now Pat. No. 8,395,039.

(51) Int. Cl.
*B08B 9/02* (2006.01)

(52) U.S. Cl.
USPC ..... 134/22.1; 134/22.18; 134/32; 165/5; 165/95

(58) Field of Classification Search
USPC ..... 134/10, 22.1, 22.11, 22.12, 22.18, 32, 134/42; 165/5, 95
See application file for complete search history.

(56) References Cited

U.S. PATENT DOCUMENTS

| | | | | |
|---|---|---|---|---|
| 2,857,922 | A | 10/1958 | Effinger | |
| 3,052,245 | A | 9/1962 | Nagle | |
| 3,060,064 | A | 10/1962 | Zingg | |
| 3,825,723 | A * | 7/1974 | Roeser | 219/401 |
| 4,460,005 | A * | 7/1984 | Rodger | 134/104.4 |
| 4,509,544 | A | 4/1985 | Mains, Jr. | |
| 5,018,544 | A | 5/1991 | Boisture et al. | |
| 5,437,296 | A * | 8/1995 | Citino | 134/108 |
| 5,651,380 | A * | 7/1997 | Sargeant et al. | 134/105 |
| 6,068,815 | A * | 5/2000 | Oberleitner et al. | 422/28 |
| 7,575,641 | B2 | 8/2009 | Joseph | |
| 2006/0144445 | A1 * | 7/2006 | Kuenzler | 137/533 |
| 2006/0185691 | A1 * | 8/2006 | Joseph | 134/22.1 |

FOREIGN PATENT DOCUMENTS

| | | |
|---|---|---|
| CN | 1811331 | 8/2006 |

* cited by examiner

*Primary Examiner* — Saeed T Chaudhry
(74) *Attorney, Agent, or Firm* — James M. Duncan; R. Scott Kimsey

(57) ABSTRACT

An improved method for cleaning heat exchange tube bundles, fin-fans, and other elongated components, using a portable cleaning system comprising a cleaning unit having a cleaning enclosure that receives and cleans the component and a control unit that controls the operation of the system. The cleaning unit has a cleaning enclosure defining a chamber sized and configured to receive the component through a sealable lid. A roller assembly rotates the component while a spray assembly sprays cleaning fluid over and into the rotating component. The cleaning fluid is heated in the chamber using surface heating elements attached to heat transfer plates along sections of the chamber walls. A vapor recovery system captures and treats toxic vapors. In use, the cleaning system is transported to a facility to clean the components on-site using cleaning fluid supplied by the facility and discharging waste to the facility.

6 Claims, 10 Drawing Sheets

METHOD FOR CLEANING HEAT EXCHANGER TUBE BUNDLES

CROSS-REFERENCE TO RELATED APPLICATION

This application claims domestic priority to U.S. Utility patent application Ser. No. 12/847,967 filed on Jul. 30, 2010.

BACKGROUND OF THE INVENTION

A. Field of the Invention

The field of the present invention relates generally to methods and systems for cleaning large elongated structures such as heat exchanger tube bundles, fin-fans, cooling towers and the like. In particular, the present invention relates to such methods and systems that are configured to be portable so they may be moved to the location of the structure and used on-site. Even more particularly, the present invention relates to such methods and systems that are able to utilize site-produced cleaning fluids, reprocess waste fluids on-site and contain all exhaust gases so as to clean such structures in an economically and environmentally-friendly manner.

B. Background

Many types of facilities utilize heat exchanger systems having heat exchanger tube bundles, fin-fan cooling apparatuses, cooling towers and the like. One industry in particular that utilizes many such heat exchanger systems is the petroleum refining industry. The efficiency of the heat exchanger affects the rate of producing product and the cost of the final product. As well known by those skilled in the art, heat exchangers are prone to fouling, with the frequency and extent of the fouling generally dependent on the type of fluids that flow within the heat exchanger. A fouled heat exchanger will adversely affect the production rate and increase the cost of producing the product, primarily as a result of the fact that the temperature of the heating fluid must rise if heat is to be transferred by the tube bundles or other components to the fluid flowing within the tubes or other apparatuses. As such, it is common to monitor the heat exchange efficiency of the heat exchanger and to periodically, or even routinely, clean the fouled components thereof so as to maintain as close to an optimum operating criteria as possible for the heat exchanger.

Cleaning heat exchanger components generally requires the heat exchanger, and therefore usually the associated production line, be taken off-line. One common method of cleaning heat exchanger components, such as heat exchanger tube bundles, is to remove the tube bundles from the heat exchanger and then direct a very high-pressure spray of fluid, typically water, against the outer surface of the tube bundles. Unfortunately, blasting water at high pressure against the outer surface of the tube bundles can damage components thereof and push the debris more to the center of the tube bundle where the debris can interfere with the flow of air or other fluids through the tube bundle. In addition, the high pressure spray results in significant waste fluid in the cleaning, area and can cause fumes to be released to the atmosphere. An alternative method of cleaning tube bundles and other heat exchanger components is with the use of chemicals, typically mildly acidic compounds, that are directed generally over the components or in which the components soak. To be effective, the chemical compounds must be strong enough to remove the material which is fouling the heat exchanger components and be able to remove the material from the center of the tube bundle or other component. Use of such chemicals require transport of the chemicals to the site where the cleaning is to be performed, transfer of the components to the cleaning site (if not done on-site) and disposal of the liquid and solid waste. Use of chemicals can also result in the release of toxic vapors to the atmosphere. Another alternative cleaning method involves the use of foam or foam-like products that interact with the debris build-up on the tube bundles or other components to dissolve the debris and clean the component. As with the chemical treatment procedures, however, use of foam results in waste products that must be disposed of and can emit toxic vapors to the atmosphere.

As stated above, the primary prior art methods of cleaning fouled tube bundles and other heat exchanger components result in waste liquids that are contaminated with the compounds used in the processing facility and with any compounds that are used to clean the components and results in the release of toxic vapors to the atmosphere. The handling of the often toxic waste liquids and the release of toxic vapors to the atmosphere are increasingly subject to various governmental laws and regulations that are intended to ensure the liquids are properly handled and disposed of and to limit the amount and/or toxicity of the vapors released to the atmosphere. With regard to some types of contaminated liquids and toxic vapors, the laws and regulations can substantially prohibit the release of the liquids or vapors. In general, these laws and regulations are likely only to become more restrictive over time and result in higher costs to clean tube bundles and other heat exchanger components.

To address concerns with regard to prior art methods and systems of cleaning tube bundles and other heat exchanger components, various mechanical systems, including a number of patented devices, systems and methods, have been developed to mechanically clean tube bundles and like structures. One such example is found in U.S. Pat. No. 3,052,245 to Nagle, which describes an apparatus for cleaning heat exchanger tube bundles that comprises a carriage that rotatably supports a tube bundle on one end with a pair of driven rollers and at the opposite end on a pair of idler rollers. High velocity, high pressure jets of hot water are discharged onto the rotating bundle through nozzles carried by a pair of headers supported by a wheeled carriage assembly that moves each header in opposite directions longitudinally along the rotating bundle. Another example of an apparatus for cleaning tube bundles is found in U.S. Pat. No. 3,060,064 to Zingg, which describes a cleaning apparatus that rotatably supports a tube bundle at each end thereof while three nozzles direct a spray toward the tube bundle as the nozzles move longitudinally along the tube bundle while the bundle rotates. One nozzle directs a spray of gas flame, another nozzle directs a spray of steam and the third nozzle directs a jet water or other liquid towards the tube bundle. Water or other coolant fluid is pumped through the tubes from an open reservoir, which may comprise a heater unit to pre-heat the coolant fluid before it is pumped through the tube bundle. U.S. Pat. No. 4,509,544 to Mains, Jr. describes a tube bundle cleaning apparatus having a plurality of high pressure water jets spraying on the tube bundle as it is rotatably supported by a set of power rollers. Jet nozzles are supported by a non-rotatable cleaning head and a rotatable cleaning head that are mounted on a pair of carriages that move along the length of opposite sides of the tube bundle while the water is sprayed thereon. The carriages move back and forth in repeated cycles as the tube bundle is rotated to different angular positions by the power rollers. U.S. Pat. No. 5,018,544 to Boisture describes an apparatus for cleaning tube bundles comprising a truck mounted fluid and hydraulic source, a trailer mounted system for rotatably supporting a tube bundle and a remote control pedestal from which an operator may control the cleaning operations. The trailer mounted system also has an articulatable mobile crane for raising and lowering the tube bundle and a set of outriggers for stabilizing the trailer during cleaning operations.

To address concerns with regard to the discharge of waste liquids and toxic vapors from the tube bundle cleaning operations, several modern systems include mobile units that are configured to be generally self-contained and more environmentally-friendly. For instance, U.S. Pat. No. 5,437,296 to Citino describes a tube bundle cleaning device having a mobile base defining a main reservoir with an interconnected bottom structure that defines a cleaning fluid reservoir. The tube bundle is rotatably supported on roller assemblies inside the main reservoir, above the cleaning fluid reservoir, and a pair of doors enclose the tube bundle therein. Cleaning fluid is placed within the cleaning fluid reservoir and heated to the desired temperature by heating elements inside the cleaning fluid reservoir. The cleaning fluid is pumped from the cleaning fluid reservoir to a separate sump where a main pump assembly pressurizes the cleaning fluid and directs it so a spray nozzle assembly that sprays the cleaning fluid on the tube bundle rotating inside the main reservoir. The sump is in fluid communication with the main reservoir such that filling the sump partially fills the main reservoir and used cleaning fluid from the main reservoir is re-circulated through the sump, filtered and then re-used. The cleaning fluid solution is drained back into the cleaning fluid reservoir and stored for future use or later disposal or reprocessing. U.S. Pat. No. 7,575,641 to Joseph describes a tube bundle cleaning method and system which comprises a similarly configured tube bundle cleaning device except it has a single door that is configured to sealably enclose the tube bundle inside the main reservoir, a vapor lock seal positioned around the top of the reservoir enclosure and a purge system to capture fumes from within enclosed areas of the device and filter the fumes to prevent venting of the fumes to the atmosphere. In use, the cleaning fluid reservoir is filled at the cleaning site with cleaning fluid and emptied after cleaning is complete.

Despite the foregoing, what is needed is an improved cleaning system for cleaning heat exchanger tube bundles, fin-fans, towers and similar elongated structures. The improved cleaning system should more effectively and efficiently clean tube bundles and other such structures. The improved cleaning system should be portable and utilize site available cleaning fluids so the cleaning operations may take place on-site, thereby avoiding the need to transport the structures and/or cleaning fluids. The improved cleaning system may be configured so as to be an entirely self-contained unit and allow the operator to safely and effectively clean tube bundles and like structures without discharging any contaminated fluid or toxic vapors to the environment.

SUMMARY OF THE INVENTION

The portable cleaning system of the present invention provides the benefits and solves the problems identified above. That is to say, the present invention provides an improved cleaning system for effectively and efficiently cleaning heat exchanger tube bundles, fin-fans, towers and similarly elongated structures. The cleaning system of the present invention is relatively portable and may utilize cleaning fluids from the site where the tube bundles or other structures are used so as to eliminate the need to transport such structures and/or the cleaning fluids. In one embodiment, the improved cleaning system of the present invention is entirely self-contained, requiring only the cleaning fluids and a source of power, which may also be supplied by the site. The improved cleaning system does not discharge any cleaning fluids or waste products to the environment and does not vent or otherwise release any toxic vapors to the atmosphere, thereby eliminating hazardous waste cleanup and air pollution. The preferred cleaning system completely cleans to the center of the heat exchanger tube bundles to allow the tube bundles to be quickly placed back in operation with improved operating efficiency and production capacity.

In one embodiment of the present invention, the cleaning system generally comprises a cleaning unit configured to receive and effectively clean one or more heat exchanger tube bundles. A separate control unit may be used to control the operation of the cleaning unit. The cleaning unit has a cleaning enclosure with a bottom wall, a pair of opposing upstanding sidewalls, a pair of opposing upstanding end walls and a lid that is pivotally attached to one of the sidewalls. The cleaning enclosure defines a chamber that is sized and configured to receive the tube bundle and a cleaning fluid therein. The cleaning fluid may be a petroleum distillate or like liquid that is a product or a by-product of the facility where the component is being cleaned or a variety of chemical solutions supplied by the operator or the facility. A sealing mechanism interconnects the sidewalls and the end walls to sealably close the lid against the sidewalls and the end walls to prevent the release of fluids and vapors from the chamber while the system is cleaning components with the cleaning fluid. One or more roller assemblies are positioned inside the cleaning enclosure and configured to rotate the one or more tube bundles therein. Each of the roller assemblies has at least one drive roller. Typically, the roller assemblies will comprise a pair of drive rollers, a pair of idler rollers and a rotating mechanism that rotates the drive rollers. A spray assembly disposed inside the chamber sprays the cleaning fluid over the length of the one or more elongated components. The spray assembly comprises a plurality of spray nozzles that are directed generally inward from at least one of the sidewalls and/or the end walls of the cleaning enclosure. A pump system is in fluid flow communication with the chamber so as to draw the cleaning fluid from the chamber, pressurize the cleaning fluid and then direct the cleaning fluid to the spray assembly. A heating system is utilized to heat the treating fluid to more effectively clean the tube bundle or other component. The heating system has a plurality of fluid heating assemblies located along each of the sidewalls. Each fluid heating assembly comprises a heating element that is disposed against a heat transfer plate inside a heater cavity at a wall section of the sidewalls so as to be in thermal conductive contact with the cleaning fluid when the cleaning fluid is in the chamber. The heater cavity is defined between the heat transfer plate and a cover plate, with the heat transfer plate being selected so as to transfer heat from the heating element to the treating fluid in the chamber during use thereof. Positive pressure may be applied to the heating cavity by connecting an appropriate conduit, such as instrument tubing, through the cover plate with the conduit attached to a compressor or pressurized tank. Application of positive pressure to the cavity will inhibit flow of treatment fluids into the cavity in the event of a leak in the heat transfer plate. An embodiment of the system of the present invention also has a vapor recovery system configured to draw vapors from the chamber and filter the vapors prior to venting gases from the cleaning enclosure. Control panel is configured to operatively control the movement of the lid between an open position and a closed position thereof, the rotation of the one or more drive rollers, the operation of the pump system, the energization of the heating assemblies and the operation of the vapor recovery system. In one embodiment, the spray assembly comprises an upper spray system, a lower spray system and an end spray system. The upper spray system has an upper manifold at each of the sidewalls and a plurality of upper spray nozzles directed generally inward and downward into the chamber. The lower spray system has a lower manifold located at or near the bottom of each of the sidewalls or along the bottom wall and a plurality of lower spray nozzles that are directed generally inward and upward into the chamber. The end spray system has an end manifold at each of the end walls and a plurality of end spray nozzles directed inward into the chamber. The treating fluid is received into the chamber, typically by being pumped into the chamber, through an intake/discharge port located at one of the sidewalls or the end walls. This same port is used to drain the used treating fluid from the chamber. A pair of liquid level sensors may be operatively configured to monitor the high and low level of the cleaning fluid in the chamber. In one embodiment, the control unit has a control enclosure that encloses one or more control panels and one or more control consoles in an interior space thereof. A forced air cooling system may be in air flow communication with the control enclosure so as to place positive pressure in the interior space of the control enclosure to prevent entry of potentially explosive fumes.

The method of cleaning one or more exchanger tube bundles of the present invention comprises the steps of (a) providing a cleaning unit that has a cleaning enclosure which defines a chamber that is sized and configured to receive an elongated component, such as a tube bundle, and a control unit for controlling the operations of the cleaning unit; (b) opening a lid to the chamber to provide access to the chamber; (c) placing the tube bundle on a roller assembly comprising a drive roller and an idler roller disposed inside the chamber; (d) closing the lid to sealably enclose the tube bundle inside the chamber; (e) pumping cleaning fluid into the chamber; (f) activating a heating system to energize one or more heating elements that are disposed against a heat transfer plate in a heater cavity at a wall section of a sidewall defining the chamber so as to transfer heat from the one or more heating elements to the treating fluid through the heat transfer plate to heat the treating fluid; and (g) operating the roller assembly and the spray assembly to rotate the tubing bundle inside the chamber and to spray the treating fluid onto the tube bundle. The method may also comprise the step of monitoring the level of treating fluid in the chamber after the pumping the treating fluid into the chamber with a high liquid level sensor and a low liquid level sensor operatively disposed inside the chamber. The method may also comprise the step of forcing cool air into an interior space of a control enclosure of the control unit with a forced air cooling system that is in air flow communication with the control enclosure during the operating step so as to place positive pressure in the interior space of the control enclosure and prevent entry of potentially explosive fumes therein. In another embodiment, the method may also comprise the step of drawing vapors out of the chamber during the operating step with a vapor recovery system that is also configured to filter the vapors prior to venting gases from the cleaning enclosure.

Accordingly, the primary aspect of the present invention is to provide a cleaning system for heat exchanger tube bundles that has the advantages discussed above and which overcomes the disadvantages and limitations associated with prior art cleaning systems for cleaning such structures.

It is an important aspect of the present invention to provide a cleaning system that is sized and configured to receive one or more elongated components, such as a tube bundle or the like, in a sealed chamber for effectively and efficiently cleaning the component.

It is also an important aspect of the present invention to provide a cleaning system that receives a tube bundle or like component inside a sealable chamber and sprays a heated cleaning fluid on the component while it rotates inside the sealed chamber to remove contaminants from the component without discharging waste liquid to the ground and/or venting toxic vapors to the atmosphere.

It is also an important aspect of the present invention to provide a cleaning system that heats a treating fluid inside a walled chamber, which is sized to receive a tube bundle or the like for cleaning, by utilizing heating elements that are attached to a heat transfer plate at one or more wall sections along one or more of the chamber walls in a manner that does not excessively heat the exterior surface of the chamber walls.

It is also an important aspect of the present invention to provide a cleaning system that comprises a control unit that is separate from a cleaning unit that receives and cleans a tube bundle or like component so that the various electrical control systems may be positioned a safe distance from the cleaning unit.

The above and other aspects and advantages of the present invention are explained in greater detail by reference to the attached figures and the description of the preferred embodiment which follows. As set forth herein, the present invention resides in the novel features of form, construction, mode of operation and combination of the above presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE EMBODIMENTS

With reference to the figures where like elements have been given like numerical designations to facilitate the reader's understanding of the present invention, the embodiments of the present invention are set forth below. The enclosed text and drawings are merely illustrative of one or more embodiments and, as such, disclose one or more different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein are generally directed to use of the present invention to clean one or more heat exchanger tube bundles, those skilled in the art will readily understand that this is merely for purposes of simplifying this disclosure and that the present invention is not so limited.

Figure 1:
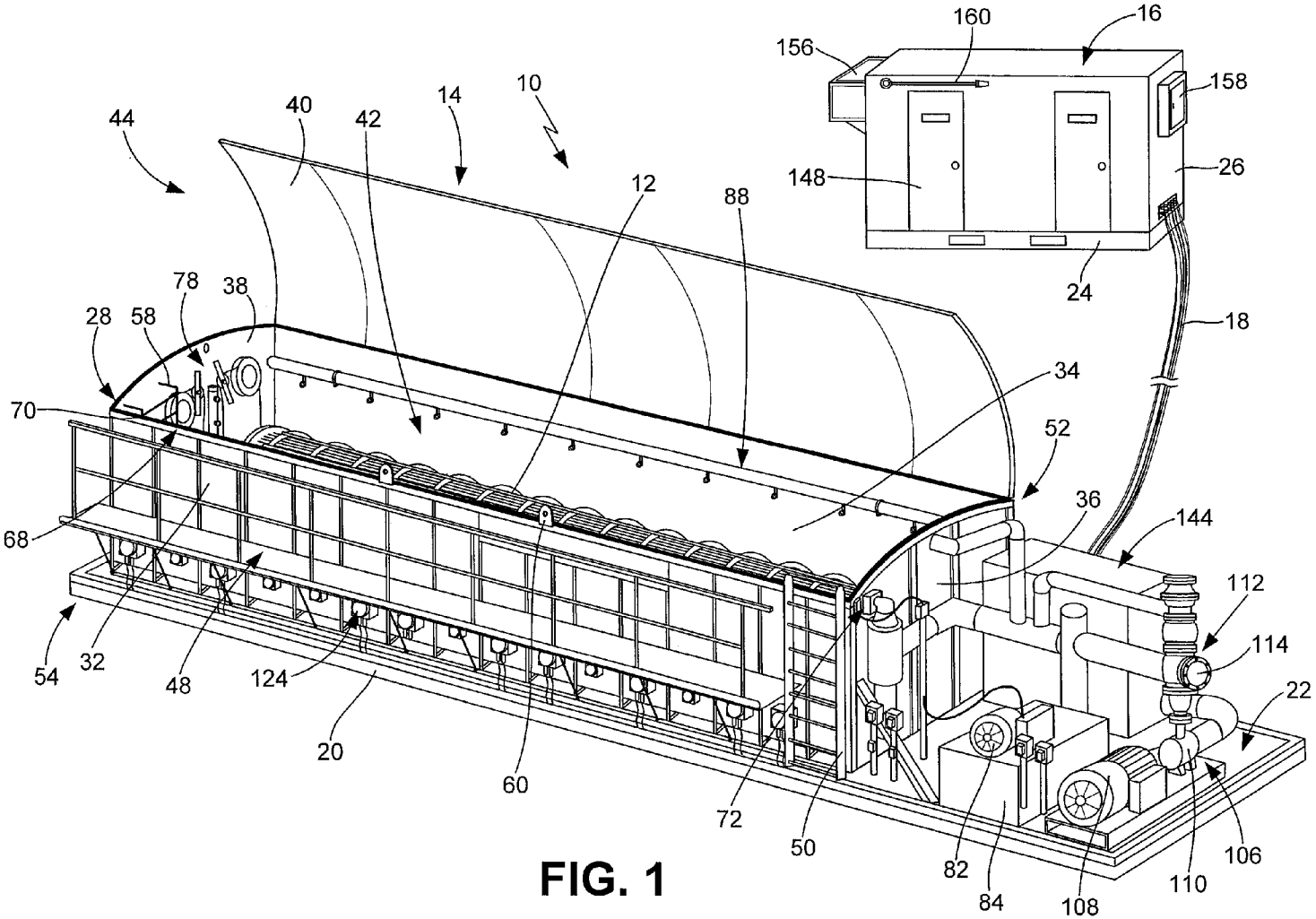
FIG. 1 is a top perspective view of a cleaning system that is configured according to a preferred embodiment of the present invention shown with a heat exchanger tube bundle positioned inside the cleaning enclosure with the door in its open position.
Figure 2:
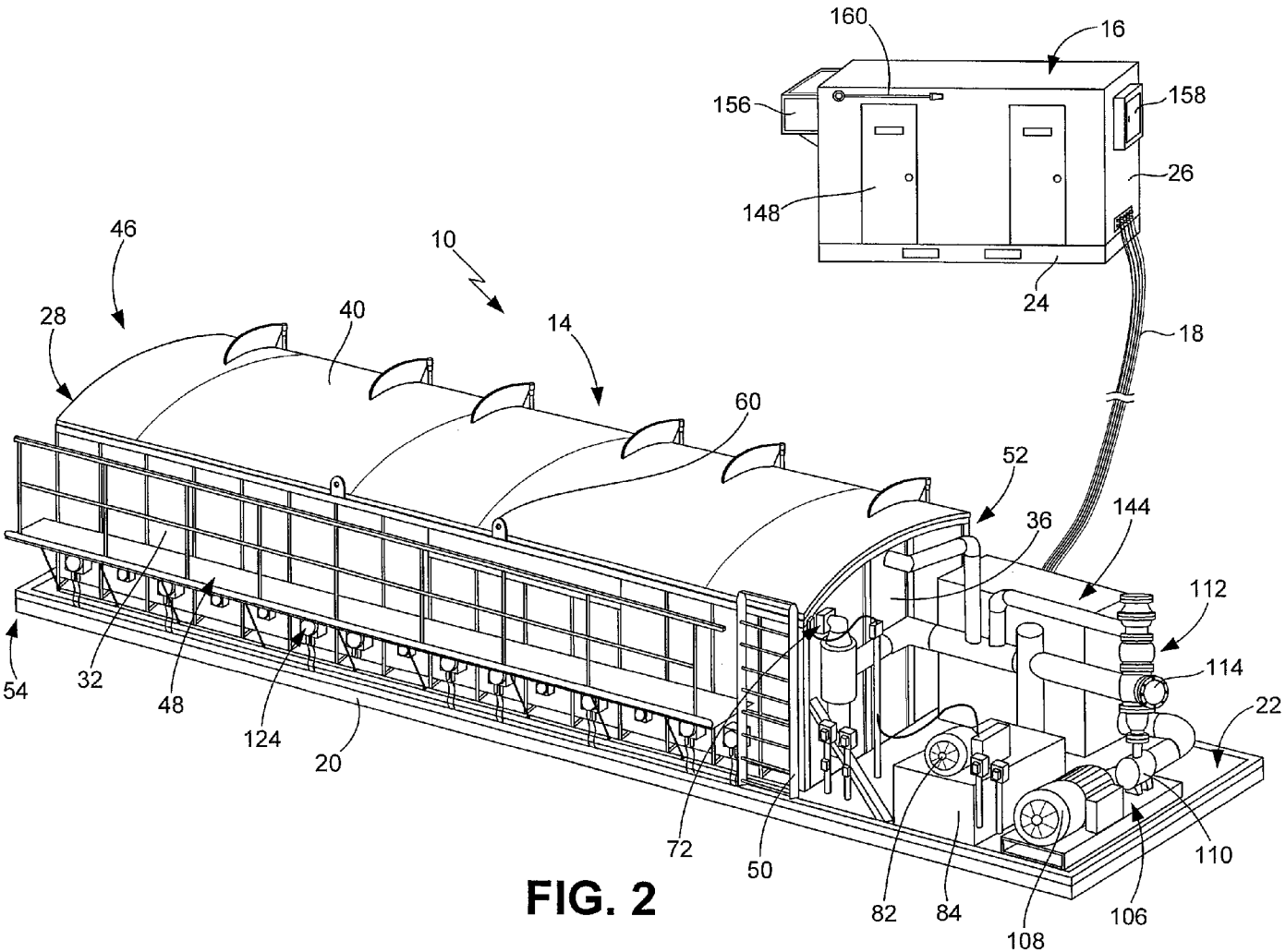
FIG. 2 is a top perspective view of the cleaning system of FIG. 1 with the door shown in its closed position.

A cleaning system that is configured pursuant to a preferred embodiment of the present invention is shown generally as 10 in FIGS. 1 and 2. As set forth in more detail below, the cleaning system 10 may be configured to be portable and to rotatably support an elongated component, such as the tube bundle 12 shown in FIGS. 1 and 2, while it is cleaned to remove contaminants which are fouling the tube bundle 12 and, as a result, adversely affecting the efficiency of the heat exchanger or other equipment which is using the tube bundle 12 or other component and the production capacity of the facility utilizing the heat exchanger or other equipment. In one configuration, the system 10 of the present invention primarily comprises a cleaning unit 14 that has equipment that is sized and configured to receive and thoroughly clean one or more various sized tube bundles 12 and/or like elongated components and a control unit 16 configured to allow an operator to operatively and safely control the various functions of the cleaning unit 14. As shown in FIGS. 1 and 2, in using the system 10, the control unit 16 is placed in spaced apart relation to the cleaning unit 14 with a plurality of wires 18 interconnecting the control unit 16 with the cleaning unit 14 during use of system 10. The cleaning unit 14 is mounted on a cleaning base structure 20 having an upwardly facing surface 22 on which the equipment of the cleaning unit 14 is attached and the control unit 16 has a control base structure 24 supporting a control enclosure 26, such as the small building shown in FIGS. 1 and 2. The cleaning base structure 20 and control base structure 24 are both configured to allow, respectively, movement of cleaning unit 14 and control unit 16 so the system 10 may be moved to the site where one or more tube bundles 12 and/or other elongated components need to be cleaned. As set forth in more detail below, in one embodiment of the present invention, the system 10 will clean both the inside and outside of tube bundles 12 utilizing cleaning fluids supplied by the site where the cleaning is to be performed and will discharge all waste fluids and any solids to the facility for reprocessing, thereby eliminating the need to transport cleaning fluids or discharge, whether intentional or accidental, waste to the environment. As also set forth below, the cleaning unit 14 will process all vapors associated with the cleaning of tube bundles 12 to eliminate discharge of toxic gases to the atmosphere.

The cleaning unit 14 has a cleaning enclosure 28 that is sized and configured to receive tube bundle 12 and prevent release of any liquid or gases during the cleaning process. As shown in FIGS. 1 through 6, the cleaning enclosure 28 has a bottom wall 30, a pair of opposing, spaced apart upstanding sidewalls 32 and 34, a pair of opposing, spaced apart upstanding end walls 36 and 38 and a lid 40 pivotally attached to one of the sidewalls 32/34, such as sidewall 34 shown in the figures. The bottom wall 30, sidewalls 32/34, end walls 36/38 and lid 40 define a chamber 42 that is sized and configured to receive one or more tube bundles 12 or like elongated components therein for cleaning using the cleaning system 10 of the present invention. Lid 40 is configured to pivot between its open position 44 (FIG. 1) and its closed position 46 (FIG. 2). In its open position 44, lid 40 allows the operator to insert the tube bundle 12 into chamber 42 for cleaning, remove tube bundle 12 from chamber 42 after it has been cleaned and/or perform any maintenance, repair or replacement work on the equipment inside cleaning enclosure 28. In its closed position 46, the lid 40 sealably encloses the tube bundle 12 and/or like components inside chamber 42 during cleaning operations, encloses the equipment therein during storage and provides a lower profile cleaning unit 14 during transport of system 10 to or from the on-site location.

Figure 6:
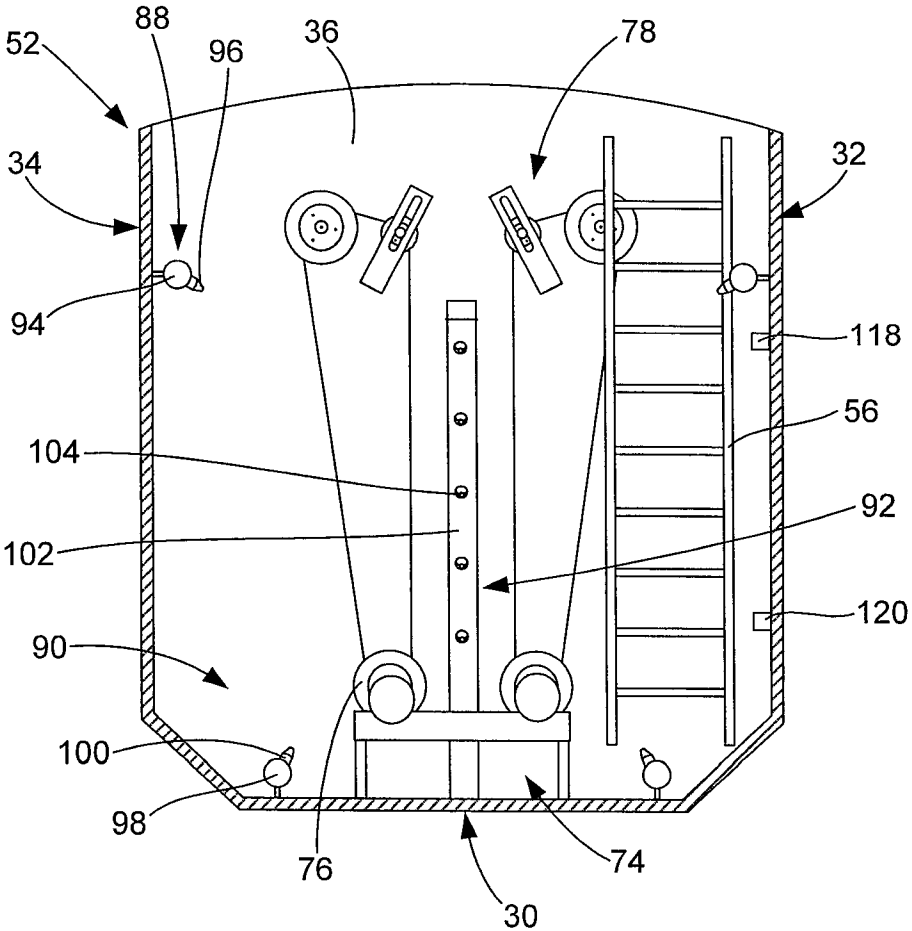
FIG. 6 is a cross-sectional view of the chamber of FIG. 5 showing the rotating mechanism at the first end of the cleaning enclosure.

As shown in FIGS. 1 and 2, in one embodiment the cleaning unit 14 has a catwalk assembly 48 that is accessed by a ladder 50 at or near the first end 52, which is defined by end wall 36, of cleaning enclosure 28. In this embodiment, catwalk 48 extends the entire length of cleaning enclosure 28 from ladder 50 to the second end 54, which is defined by end wall 38, of cleaning enclosure 28. In this embodiment, there is also a ladder 56 inside the chamber 42 at first end 52 and a ladder 58 inside chamber 42 at second end 54, as shown in FIGS. 1 and 6 to allow the operator access to chamber 42 so he or she may perform any necessary maintenance, repair or replacement work on the equipment inside cleaning enclosure 28. To assist with transport of cleaning unit 14 to and from the site where the cleaning operations are to be performed, the cleaning enclosure 28 may have a pair of anchor points 60 that are attached to or integral with cleaning enclosure 28 so that the entire cleaning unit 14 may be lifted by a crane utilizing a clevis or the like that connects at anchor points 60. In this embodiment, the cleaning unit 14 can be lifted and placed onto a flat bed trailer for transport to the site where the tube bundles 12 or other components are located.

Figure 3:
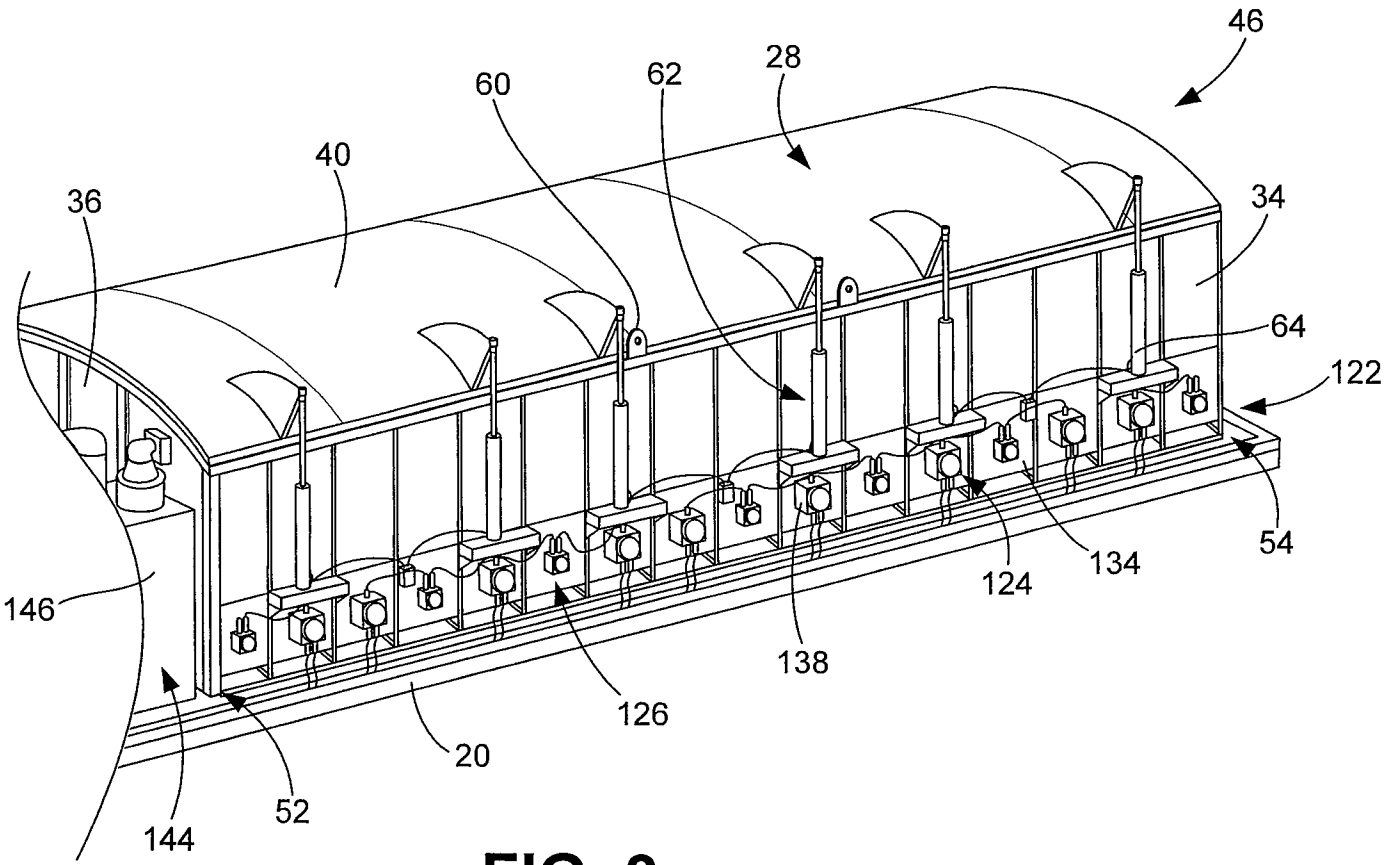
FIG. 3 is a side perspective view of the cleaning enclosure of FIG. 2.

As best shown in FIG. 3, the control unit 16 includes a lid control mechanism 62 for opening and closing the lid 40 to allow insertion or removal of the tube bundle 12 from chamber 42 when in the open position 44 and operation or movement of cleaning unit 14 when in the closed position 46. In one embodiment, the lid control mechanism 62 comprises a plurality of hydraulically actuated piston/cylinder assemblies 64, such as the six shown in FIG. 3, that interconnect the exterior of sidewall 34 and the top surface of lid 40. The piston/cylinder assemblies 64 of lid control mechanism 62 are configured to operate together to move lid 40 between its open 44 and closed 46 positions. A hydraulic system 66, schematically shown in FIG. 8, hydraulically operates piston/cylinder assemblies 64 to substantially open or securely close lid 40. A variety of sealing mechanisms 68 can be utilized with the cleaning unit 14 to sealably close lid 40 against side walls 32/34 and end walls 36/38 of the cleaning enclosure 28 and provide an entirely air-tight chamber 42. In one embodiment, the sidewall 32, lid 40 and lid control mechanism 62 are cooperatively configured so as to provide a mechanical seal at or near the top of sidewall 32. In addition, the sealing mechanism 68 can be a gasket 70, shown in FIG. 1, positioned at or near the top edges of the sidewalls 32/34 and end walls 36/38 to provide a seal so the lid 40 may be sealably closed when in use.

An embodiment of the cleaning enclosure 28 may also have a lid closure switching mechanism 72, shown in FIGS. 1 and 2, comprising one or more switches and associated sensors that are configured to determine whether the lid 40 is open or sealably closed. The lid closure switching mechanism 72 should be configured such that until it recognizes that lid 40 is closed against the walls 30-38 of the cleaning enclosure 28 it will not allow any part of the cleaning operation to begin, which will include spraying of hot, possibly toxic cleaning fluid onto tube bundle 12 and the production of potentially toxic fumes therefrom. Lid 40 being in the open position 44 will also prevent the operator placing cleaning fluid inside the chamber 42 and heating of the cleaning fluid (if in chamber 42). As will be readily appreciated by those skilled in the art, various types of switching devices and apparatuses can be utilized for lid closure switching mechanism 72.

Figure 4:
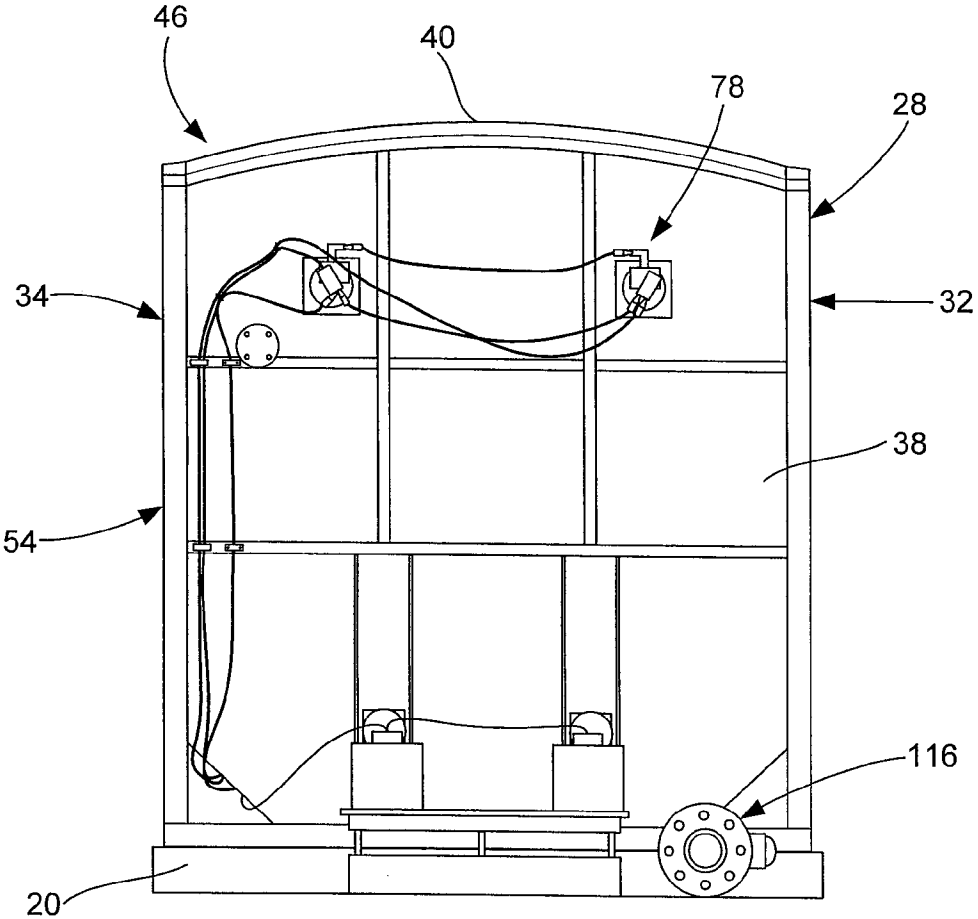
FIG. 4 is an end view of the second end of the cleaning enclosure of FIG. 2 shown without the catwalk or external ladder.
Figure 5:
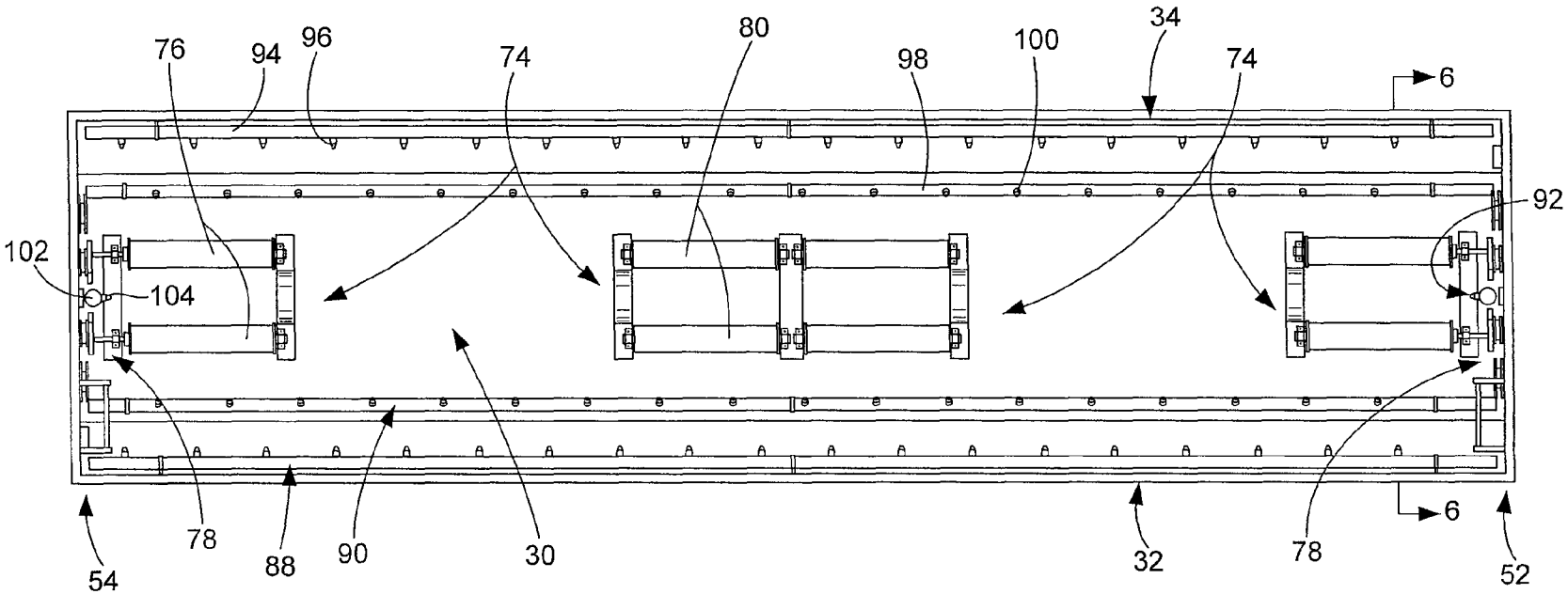
FIG. 5 is a top plan view inside the chamber to show the spray system and roller assemblies utilized with the cleaning system

As stated above, the cleaning unit 14 is configured to rotate the tube bundle 12 or like components inside cleaning enclosure 28 to more effectively spray cleaning fluid onto the surfaces of the tube bundle 12. An embodiment of the cleaning unit 14 has one or more roller assemblies, shown generally as 74 in FIG. 5, inside cleaning enclosure 28 that rotatably support tube bundle 12. The embodiment shown in the figures has a pair of roller assemblies 74 that can be utilized to rotatably support one very long tube bundle 12 or two half-sized or shorter tube bundles 12. To achieve the necessary rotation of tube bundle 12, each roller assembly 74 comprises at least one pair of spaced apart drive rollers 76 that are rotatably driven by a rotating mechanism 78. In one embodiment, the rotating mechanisms 78 for the respective roller assemblies 74 are positioned at or near the first end 52 and second end 54 of cleaning enclosure 28, as shown in FIGS. 1, 5 and 6, and comprise hydraulically powered motors that drive a pulley and belt assembly operatively connected to the drive rollers 76 fixedly attached to the bottom wall 30 of cleaning enclosure 28. FIG. 4 shows the hydraulic lines that connect the hydraulic system 66 to the pulley/belt assembly of the rotating mechanism 78 positioned at the second end 54 (i.e., end wall 38) of the cleaning enclosure 28. The roller assembly 74 may also include a pair of spaced apart idler rollers 80 that allow the tube bundles 12 to rotate in response to the rotation of the drive rollers 76. The idler rollers 80 are longitudinally spaced from the drive rollers 76 and fixedly attached to the bottom wall 30 sufficiently close to the driver rollers 76 to support the typical sized tube bundle 12 that will be cleaned by the cleaning system 10 of the present invention. A variety of different configurations, diameters and lengths of driver rollers and/or the idler rollers 80 can be utilized with roller assemblies 74. Likewise, the configuration of the rotating mechanism 78 can be varied, for instance the use of a sprocket/chain assembly can be utilized instead of the pulley/belt assembly shown in the figures, and still achieve the objectives of roller assemblies 74.

Figure 8:
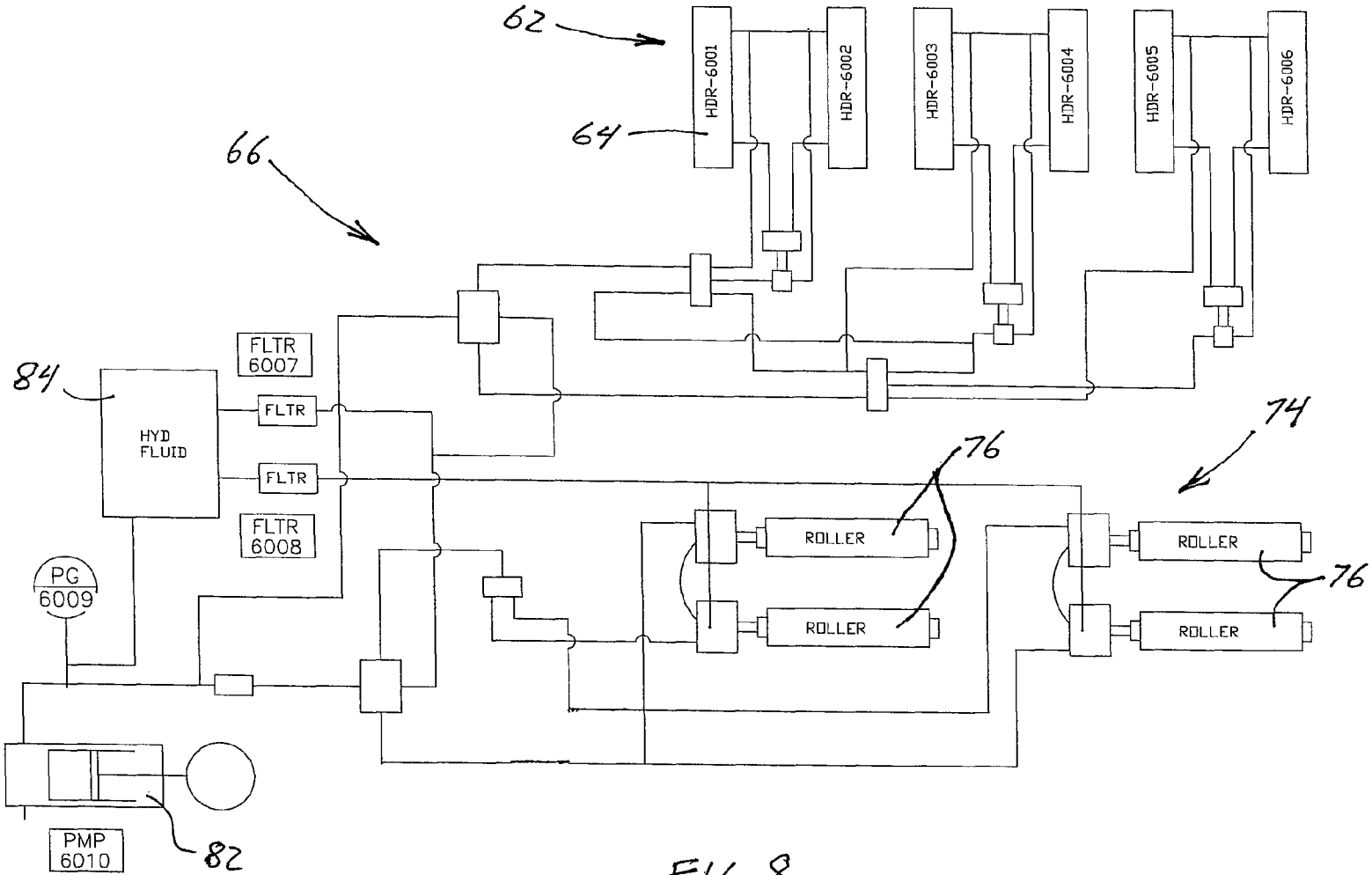
FIG. 8 is a schematic showing the hydraulic system utilized with an embodiment of the cleaning system of the present invention.

The hydraulic system 66, shown in the schematic of FIG. 8, generally comprises an electric motor 82 and hydraulic fluid tank 84 operatively connected to the hydraulic pump used to selectively supply pressurized hydraulic fluid to the piston/cylinder assemblies 63 of the lid control mechanism 62 and to the driver rollers 76 of the roller assemblies 74. As set forth below, the primary controls for the hydraulic system 66 are contained in control unit 16. If desired, remotely positioned controls, shown as 86 in FIGS. 1 and 2, can be positioned at or near the electric motor 82 and hydraulic tank 84 so the operator can start or stop the hydraulic system 66 remotely from the control unit 16. As with all relevant equipment utilized with the portable cleaning system 10 of the present invention, the electric motor 82 should be of the type that is rated as explosion proof. In one embodiment, motor 82 is a 10 hp electric motor.

Figure 9:
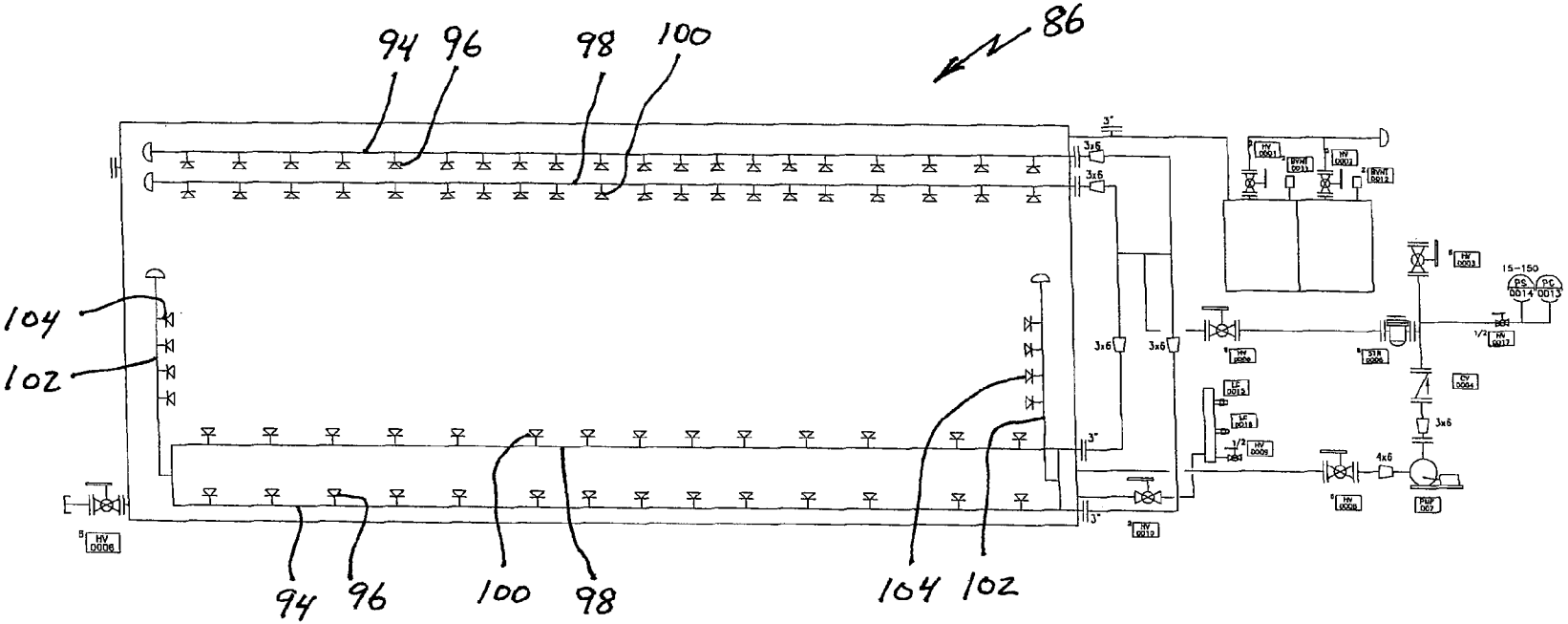
FIG. 9 is a schematic showing the spray system utilized with an embodiment of the portable cleaning system of the present invention.

The cleaning unit 14 has a spray assembly 86, best shown in FIGS. 5, 6 and 9, that is disposed inside chamber 43 and configured to direct pressurized cleaning fluid over the length of tube bundle 12 as it rotates inside chamber 42. The spray assembly 86 may comprise an upper spray system 88, a lower spray system 90 and an end spray system 92, as shown in FIGS. 6 and 9. The upper spray system 88 comprises an upper manifold 94 positioned generally toward the top of each of the opposing sidewalls 32/34 with a plurality of upper spray nozzles 96 in fluid flow connection therewith that are aimed generally inwardly and downwardly from upper manifold 94 toward where the tube bundle 12 will be rotatably supported by the roller assemblies 74. A sufficient number of high pressure upper spray nozzles 96 are utilized, which will depend on the size and type of the nozzles selected for upper nozzles 96, to ensure that the entire surface of tube bundle 12 is exposed to the high pressure spray of the cleaning fluid. Lower spray system 90 comprises a lower manifold 98 positioned generally toward the bottom of each of the opposing sidewalls 32/34 with a plurality of lower spray nozzles 100 in fluid flow connection therewith that are aimed generally inwardly and upwardly from lower manifold 98 toward where the tube bundle 12 will be rotatably supported by the roller assemblies 74. As with the upper spray system 88, the lower spray system 90 should have a sufficient number of high pressure lower spray nozzles 100 to ensure that the entire surface of tube bundle 12 is exposed to the high pressure spray of the cleaning fluid. The end spray system 92 comprises a vertically disposed end manifold 102 that is positioned generally at or near each of the opposing end walls 36/38 with a plurality of end spray nozzles 104 in fluid flow connection therewith that are aimed generally straight inwardly from end manifold 102 toward where the tube bundle 12 will be rotatably supported by the roller assemblies 74. A sufficient number of high pressure end spray nozzles 104 are utilized to ensure that the ends of the tube bundle 12, which are generally open and, as such, will allow cleaning fluid inside the tubes thereof, are exposed to the high pressure spray of the cleaning fluid.

The cleaning unit 14 has a pump system 106, best shown in FIGS. 1 and 2, that is hydraulically connected to chamber 42 to draw cleaning fluid therefrom and to the spray assembly 86 to spray the pressurized cleaning fluid onto the tube bundle 12 or like component rotating in chamber 43. The pump system 106 may comprise an electric motor 108, a pump 110 and a valving system 112, including check valve 114, that are sized and configured to draw the cleaning fluid from the chamber 42 defined by the cleaning structure 28, pressurize the cleaning fluid to the desired pressure (typically at least 100 psi) and direct the pressurized cleaning fluid to the spray system 86 where it is sprayed through nozzles 96, 100 and 104 onto the rotating tube bundle 12. In one embodiment, the motor 108 is a 75 hp explosion proof electric motor and the pump 110 is a stainless steel pump. The pump system 106 may also include one or more filter mechanisms, such as a mesh screen and/or filter socks, to filter the cleaning fluid while it is circulating through pump system 106 to prevent clogging of the spray nozzles 96, 100 and 104 during operation of cleaning system 10.

The cleaning fluid that is pressurized by the pump system 106 is placed inside chamber 42 through an intake/discharge port 116 located at the second end 54 of the cleaning enclosure 28, as shown in FIG. 4. In an embodiment of use of cleaning system 10, the cleaning fluid is obtained from the location where the cleaning operations are to be performed and the waste fluid is discharged through intake/discharge port 116 back to the facility for reprocessing, thereby avoiding the need to transport any cleaning fluid and/or waste product to or from the site. Alternatively, the operator of cleaning system 10 can supply the cleaning fluid and provide a truck to haul away the waste fluid for reprocessing at another facility. In one embodiment, the cleaning unit 14 also has high/low liquid level sensors 118/120, shown in FIG. 6, that are configured to shut down the cleaning system 10 if the level of the cleaning fluid inside chamber 42 is too high (sensor 118) of the level of the cleaning fluid inside chamber 42 drops too low (sensor 120). As will be readily appreciated by those skilled in the art, the cleaning unit 14 has an upper limit on the amount of cleaning solution that can be inside chamber 42 and still function (e.g., the spray assembly 86) as intended and also requires a minimum level of cleaning solution in the chamber 42 (e.g., a sufficient amount for pump system 106) to function efficiently and effectively.

Figure 7:
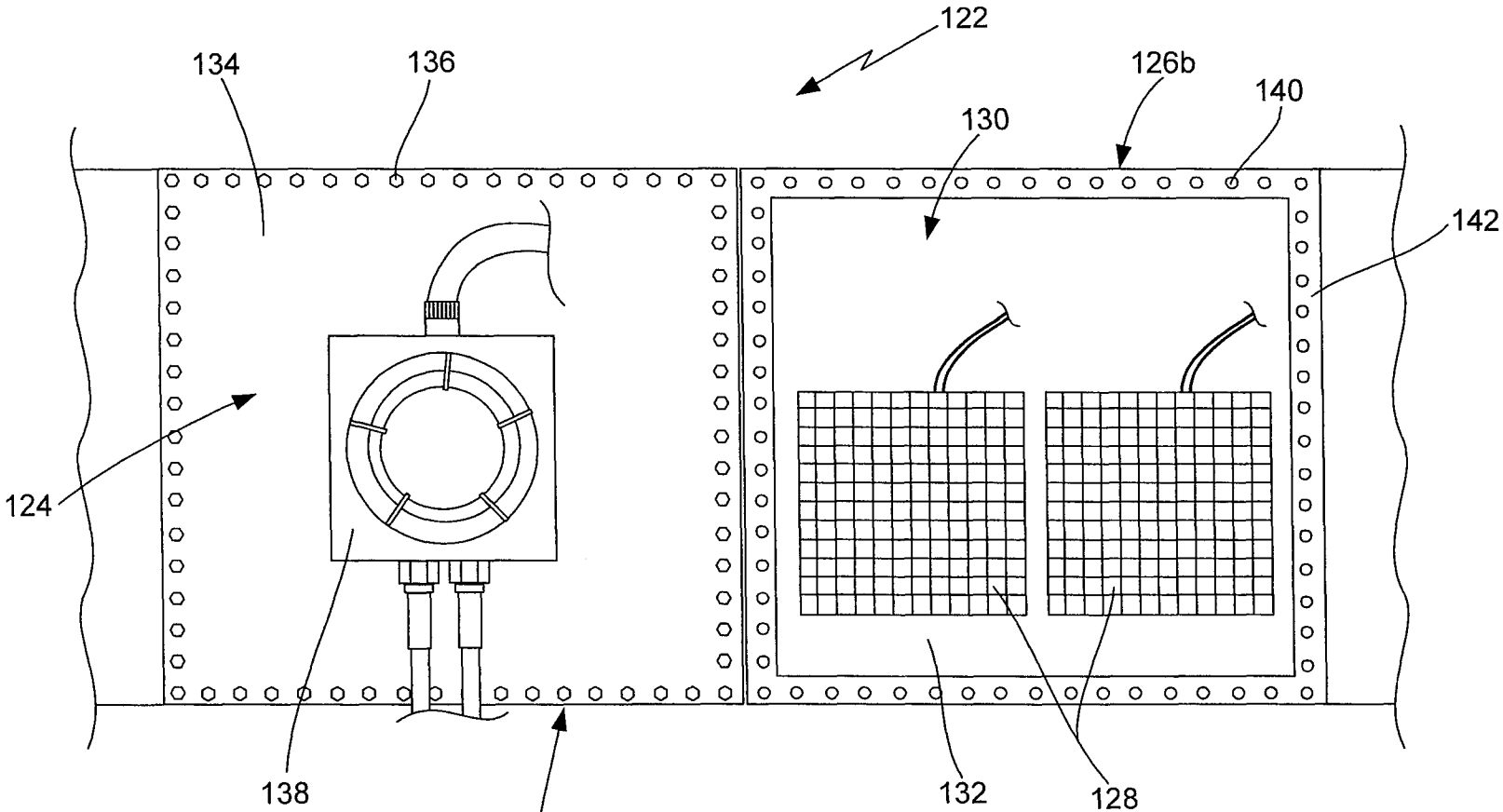
FIG. 7 is a side view of one of the sides of the cleaning enclosure showing a pair of adjacent wall sections with the heater controller and outer panel removed from one of the wall sections to illustrate the heater elements disposed in the heater cavity against a heat transfer plate.

As known in the art, heating the cleaning fluid to a temperature of 140 to 200 degrees Fahrenheit is typically very beneficial to the cleaning action resulting from spraying the heated cleaning fluid on the tube bundle 12 being rotated inside chamber 42. Prior art systems have utilized a plurality of heating elements disposed inside a separate fluid reservoir located below the bottom wall of the enclosure that receives, rotates and cleans tube bundle 12, as exemplified by U.S. Pat. Nos. 7,575,641 and 5,437,296. In these systems, the heating element is an immersion-type of heater that is configured to transfer heat directly to the cleaning fluid. In contrast, the cleaning system 10 of the present invention utilizes an improved heating system, shown as 122 in FIGS. 3 and 7, to indirectly heat the treating fluid while it is in chamber 42 prior to pressurization of the fluid for spraying by spray assembly 86. As shown in FIGS. 3 and 7, heating system 122 comprises a plurality of fluid heating assemblies 124, each one of which is disposed at a wall section 126 of one or more of the walls, typically sidewalls 32 and/or 34. Each fluid heating assembly 124 has a surface heating element 128 that is disposed inside a heater cavity 130 and attached to a heat transfer plate 132 which is in thermal-conductive relation with the inside of chamber 42 so as to transfer heat from respective sidewall 32/34 at wall section 126 to the treating fluid inside chamber 42 to heat the treating fluid to the desired temperature. FIG. 7 shows two adjacent wall sections, shown as wall section 126*a* and 126*b*, each having a fluid heating assembly 124 associated therewith. Section 126*a* shows a fluid heating assembly 124 as it is assembled and ready for use, with a cover plate 134 removably mounted over the heater cavity 130, typically attached using a plurality of connectors 136 (such as bolts or screws), and a heating element cover 138 that distributes power from the control unit 16 to energize the surface heating element 128. Section 126*b* shows the fluid heating assembly 124 with the cover plate 134 and heating element cover 138 removed to expose the heating elements 128, heater cavity 130 and heat transfer plate 132. Typically, the connectors 136 will be threadably received in apertures 140 in a frame 142 that is disposed around the perimeter of heater cavity 130 and configured so as to position the cover plate 134 in spaced apart relation to heat transfer plate 132 and define the heater cavity 130 having the one or more surface heating elements 128 therein, as shown in FIG. 7.

In one embodiment, surface heating element 128 comprises a commercially available 85V, DC powered ceramic heating element that is capable of temperatures ranging from 1,400 to 2,000 degrees Fahrenheit that has a high temperature thermal insulating (or HTI) blanket on the outside directed surface thereof to prevent the cover plate 134 and other exposed surfaces from getting too hot during use of the fluid heating assembly 124. The ceramic heater portion of the heating element 128 is positioned against the heat transfer plate 132, which can be a 0.25 inch thick metal plate. An acceptable heating element 128 is the flexible ceramic pad heater manufactured by Heat Treating Incorporated. Heating element 128 is connected to a heater control console 154 which provides current to the heating element 128. The heating element 128 is secured to heat transfer plate 132 using one or more appropriate connecting mechanisms.

An embodiment of the cleaning unit 14 of cleaning system 10 may also include a vapor recovery system 144 configured to capture and treat any toxic vapors resulting from cleaning tube bundle 12 or other elongated components in chamber 42, as best shown in FIGS. 1 through 3. As stated above, the lid 40 is configured to sealably close against the top edges of the sidewalls 32/34 and end walls 36/38, using sealing mechanism 68, to enclose chamber 42 and prevent the release of vapors from the cleaning enclosure 28 during cleaning operations. In one configuration, vapor recovery system 144 comprises a cabinet 146 or like structure, best shown in FIG. 3, that encloses a suction pump and a vapor treating apparatus that are cooperatively configured to draw a vacuum from chamber 42 to prevent any vapors from leaking out of the cleaning enclosure 28, treat the vapors to remove any toxic elements therein and then vent clean gas to the atmosphere. In one embodiment, the suction pump is connected to one or more carbon canisters or like devices that can effectively remove hydrocarbon fumes and other potentially toxic or otherwise dangerous materials from the vapors produced in chamber 42 during cleaning operations. Some portions of the vapor treating apparatus should be accessible through the cabinet 146 so the operator can replace the consumable filter elements or other materials as needed to ensure that no toxic vapors are released by the cleaning unit 14. If desired, the vapor recovery system 144 can also include its own control panel, including one or more gauges, meters and like devices, on the outside of cabinet 146 so the operator can view the operation of vapor recovery system 144 from cabinet 146.

Figure 10:
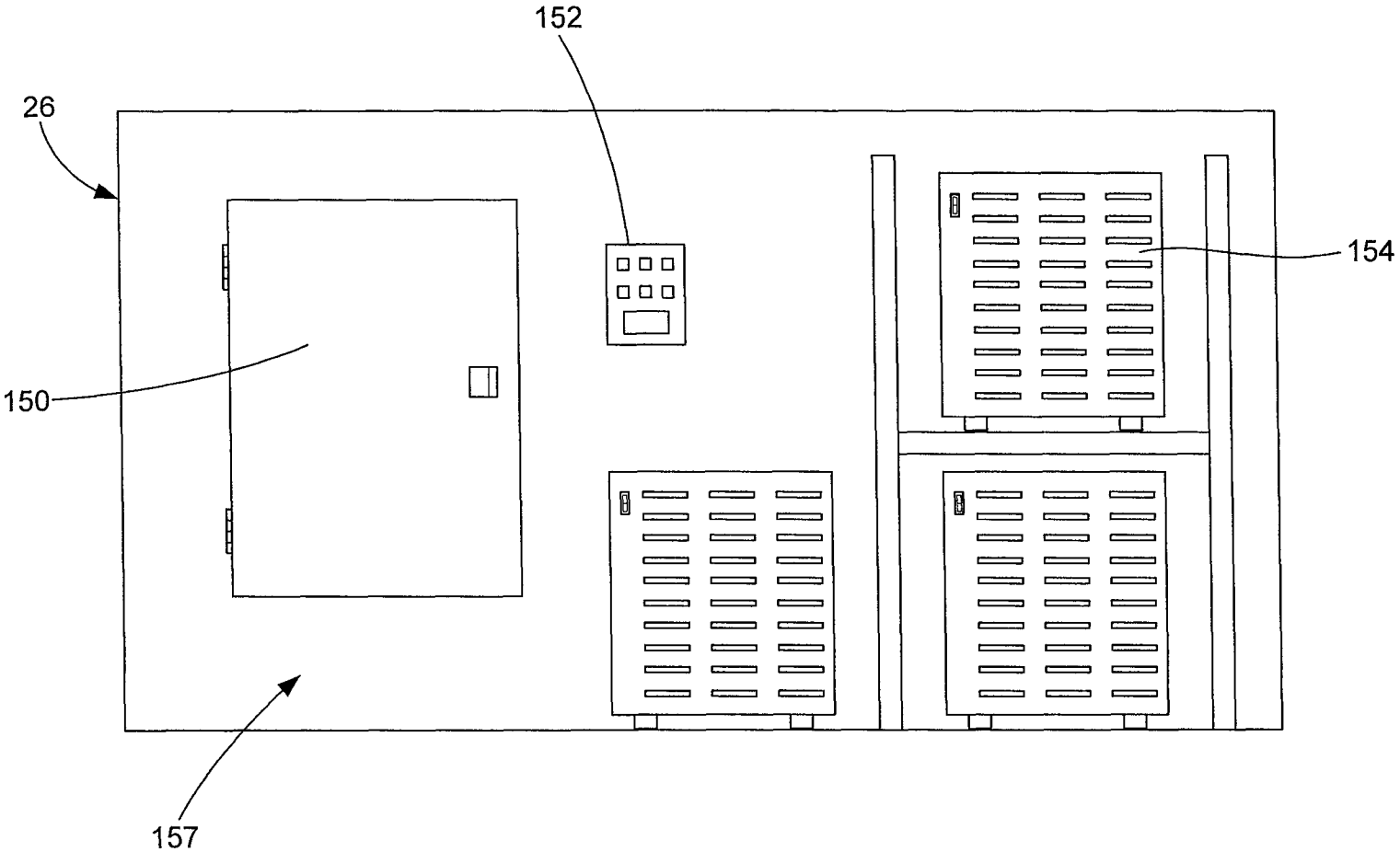
FIG. 10 is an interior view of a control unit which may be utilized with an embodiment of the portable cleaning system of the present invention.

As stated above, the operation of cleaning system 10 may be primarily controlled by the control unit 16 that is electrically connected to the cleaning unit 14 by wires 18. The control enclosure 26 mounted on control base structure 24 may be configured to be separately moveable and provide a substantially enclosed building that houses the electronic components that allow the operator to efficiently and safely operate the cleaning unit 14. One or more doors 148 provide restricted access to the electronic components inside control enclosure 26. Inside control enclosure 26, is an electronic control panel 150 that electrically controls the equipment of the cleaning system 10, a process control panel 152 that allows the operator to control the operation of cleaning system 10 and one or more (such as the three shown) heater control consoles 154 that electrically drive and control the heating system 122, as shown in FIG. 10. The components of the control unit 16 may control the operation of the lid control mechanism 62, hydraulic system 66, spray assembly 86, roller assembly 74, pump system 106, heating system 122, vapor recovery system 144 and all other equipment and operations of cleaning system 10. Process control panel 152 allows the operator to electronically start and stop the cleaning operations, monitor which equipment is running and the status of the various operating equipment and systems. The control unit 16 may also include a forced air cooling system 156, such as a three ton HVAC unit, in air flow communication with the interior space 157, shown in FIG. 10, of the control enclosure 26 to cool the electronic components inside control enclosure 26 and to provide positive pressure to the interior space 157 where the control panels 150/152 and control consoles 154 are located to prevents fumes, particularly hydrocarbon and other potentially explosive fumes, from entering control enclosure 26 and, thereby, posing an explosive risk with regard to the control panels 150/152 and control consoles 154. A breaker panel 158 having electrical breakers connected to the electronic control panel 150, process control panel 152 and heater control consoles 154 is located on the outside of the control enclosure 26. One or more alarm systems 160 may be associated with the control unit 16, such as that shown in FIGS. 1 and 2 above the door 148 into control enclosure 26, to indicate a warning signal to those near the operation of cleaning system 10. In one embodiment, alarm system 160 comprises both an audible and a visual alarm signal. Other alarms can be placed on cleaning unit 14.

In use, the cleaning system 10 is transported to a location where one or more tube bundles 12 or like components need to be cleaned so as to improve or maintain the efficient operations of the production facility, such as a refinery or other processing facility. The cleaning unit 14 is lifted onto a truck for transport using a crane that attaches a clevis or clevis-like device to the anchor points 60. The control unit 16 is lifted onto a truck for transport using a forklift or the like to engage openings in the control base structure 24. At the site, the cleaning unit 14 and control unit 16 are removed from the truck and placed at a safe location for cleaning tube bundle 12 and other components. For safety reasons, the control unit 16 should be placed a minimum of ten feet away from the cleaning unit 14. Once connected to a source of power, typically from the site or a portable electrical generator, the lid control mechanism 62 is activated to move the lid 40 from its closed position 46 (during transport) to its open position 44. The tube bundle 12 is lowered, typically using a sling or sling-like apparatus, into the chamber 42 of cleaning enclosure 28 and onto the roller assembly 74. The lid control mechanism 62 is then activated to move lid 40 to its closed position 46, thereby enclosing the tube bundle 12 inside chamber 42.

A quantity of cleaning fluid is pumped inside the chamber 42 through the intake/discharge port 116 at the second end 54 of the cleaning enclosure 28. Typically, the cleaning fluid will be a petroleum distillate or like liquid that is a product or a by-product of the facility having the tube bundle 12 to be cleaned. Alternatively, the operator of cleaning system 10 can supply the cleaning fluid and/or various chemical solutions can be utilized for cleaning. As will be readily appreciated by those skilled in the art, the specific cleaning fluid will depend on the tube bundle 12 and the type of contamination associated therewith that necessitates the cleaning operations. To capture any toxic vapors that may be produced by the cleaning fluid, particularly as it interacts with the contaminates on the tube bundle 12, the vapor recovery system 144 is started to begin drawing and treating the vapors from inside chamber 42. Once a sufficient amount of cleaning fluid is inside chamber 42, which is likely to depend on the size of tube bundle 12, the heating system 122 is activated at the control unit 16 to energize the surface heating elements 128 and supply heat to the heat transfer plate 132 at each wall section 126. The heat from the surface heating elements 128 are thermally transferred to the cleaning fluid inside chamber 42. After the treating fluid reaches the desired temperature, typically 140 to 200 degrees Fahrenheit, the roller assembly 74 is activated to start the drive rollers 76 and begin rotating the tube bundle 12 inside chamber 42. The pump system 106 is started to direct pressurized cleaning fluid to the spray assembly 86, which then sprays the cleaning fluid onto the tube bundle 12 through the spray nozzles 96, 100 and 104 while the tube bundle 12 is rotating inside chamber 42. After a sufficient amount of cleaning, the heating system 122 is turned off, the pump system 106 is deactivated to cease spraying of treating fluid by spray assembly 86, the cleaning fluid is drained from chamber 42 by suctioning it through the intake/discharge port 116, the lid 40 is moved to its open position 44 by lid control mechanism 62 and the tube bundle 12 is removed from chamber 42. Any liquid or solids remaining in chamber 42 may be removed therefrom by a vacuum truck or the like. If desired, the cleaning fluid may be left inside chamber 42 when the tube bundle 12 is removed so that it may be reused on site to clean another tube bundle 12 or like component. Once the cleaning fluid is removed from chamber 42 it can be placed back into the facility for reprocessing or other environmentally friendly manner of disposal. Cleaning fluid may also be pumped from the cleaning unit 14 through the intake/discharge port 116 to related structures, such as fin fans and cooling towers, where the cleaning fluid can be circulated through these structures to clean them and be returned to chamber 42. If desired, appropriate leads may be attached to the heater control consoles 154 so these apparatuses may be utilized with heat blankets (separate from cleaning unit 14) for stress relief purposes As will be readily apparent to those skilled in the art, the cleaning system 10 of the present invention will effectively and efficiently clean tube bundle 12 with less facility downtime, production interruption and negative environmental waste. Cleaning the tube bundle 12 with cleaning system 10 of the present invention will restore the tube bundle 12 and its associated system to the desired heat transfer efficiency, thereby increasing product production by the refinery or other facility. Use of the cleaning system 10 eliminates the pollution and time consuming and relatively expensive clean-up that results from utilization of current hydroblasting and related cleaning methods. Using the cleaning system 10 of the present invention, no waste product is discharged to the ground and no toxic vapors are emitted to the atmosphere. In one embodiment, no cleaning fluid need be transported to the cleaning location and no waste product need be transported away. Because no cleaning fluid is wasted or disposed when using cleaning system 10, the cleaning operations are generally cheaper and much more environmentally friendly.

While there are shown and described herein a specific form of the invention, it will be readily apparent to those skilled in the art that the invention is not so limited, but is susceptible to various modifications and rearrangements in design and materials without departing from the spirit and scope of the invention. In particular, it should be noted that the present invention is subject to various modifications with regard to any dimensional relationships set forth herein, with regard to its assembly, size, shape and use and with regard to the materials used in its construction. For instance, there are a number of components described herein that can be replaced with equivalent functioning components to accomplish the objectives of the present invention.

I claim:

1. A method of cleaning one or more large-scale, industrial, elongated components, said method
comprising the steps of:

a. providing a cleaning unit having a cleaning enclosure defining a chamber sized and configured to receive the one or more elongated components selected from the group consisting of heat exchanger tube bundles, finfans, and cooling towers; and a control unit for controlling the operations of said cleaning unit, said cleaning unit having a lid configured to sealably close said chamber, a roller assembly configured to rotate the one or more elongated components, a heating system to heat a cleaning fluid placed in said chamber, a pump system configured to pressurize said cleaning fluid and a spray assembly configured to spray said cleaning fluid onto the one or more elongated components inside said chamber, b. opening said lid to provide access to said chamber;

c. placing at least one of said one or more elongated components inside said chamber on said roller assembly;

d. closing said lid so as to sealably enclose the one or more elongated components inside said chamber;

e. pumping said cleaning fluid into said chamber;

f. activating said heating system to energize one or more heating elements disposed against a heat transfer plate in a heater cavity at a wall section of a sidewall defining said chamber so as to transfer heat from said one or more heating elements to said treating fluid through said heat transfer plate to heat said treating fluid;

g. providing positive pressure to said heater cavity to prevent introduction of said cleaning fluid into said heater cavity; and h. operating each of said roller assembly and said spray assembly to rotate the one or more elongated components and to spray said treating fluid onto the one or more elongated components.

2. The method of claim 1, wherein said spray assembly comprises an upper spray system and a lower spray system, said upper spray system having an upper manifold at each of said sidewalls and a plurality of upper spray nozzles directed inward and downward into said chamber, said lower spray system having a lower manifold at each of said sidewalls or at said bottom wall and a plurality of lower spray nozzles directed inward and upward into said chamber.

3. The method of claim 2, wherein said spray system further comprises an end spray system having an end manifold at each of said end walls and a plurality of end spray nozzles directed inward and into said chamber.

4. The method of claim 1 further comprising the step of monitoring the level of treating fluid in said chamber after said pumping step with a high liquid level sensor and a low liquid level sensor operatively disposed in said chamber.

5. The method of claim 1, wherein said control unit has a control enclosure enclosing one or more control panels and one or more control consoles in an interior space thereof and a forced air cooling system that is in air flow communication with said control enclosure, said method further comprising the step of forcing air into said interior space with said forced air cooling system during said operating step so as to place positive pressure in said interior space of said control enclosure and prevent entry of potentially explosive fumes therein.

6. The method of claim 1 further comprising the step of drawing vapors out of said chamber during said operating step utilizing a vapor recovery system configured to filter said vapors prior to venting gases from said cleaning enclosure.

* * * * *